US010611588B2

(12) United States Patent
Harris et al.

(10) Patent No.: US 10,611,588 B2
(45) Date of Patent: Apr. 7, 2020

(54) TWO-PART SPINDLE MECHANISM FOR A PRINTER PAPER BUCKET, A PRINTER PAPER BUCKET, AND A PRINTER HAVING A PAPER BUCKET WITH A TWO-PART SPINDLE MECHANISM

(71) Applicant: TransAct Technologies Incorporated, Hamden, CT (US)

(72) Inventors: Bruce Harris, Freeville, NY (US); David Weeks, Willseyville, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 306 days.

(21) Appl. No.: 15/796,981

(22) Filed: Oct. 30, 2017

(65) Prior Publication Data

US 2019/0127170 A1 May 2, 2019

(51) Int. Cl.

| | |
|---|---|
| ***B65H 16/06*** | (2006.01) |
| ***B41J 15/04*** | (2006.01) |
| ***B65H 19/12*** | (2006.01) |
| ***B65H 75/08*** | (2006.01) |
| ***B41J 15/02*** | (2006.01) |

(52) U.S. Cl.

CPC ..... *B65H 16/06* (2013.01); *B41J 15/02* (2013.01); *B41J 15/042* (2013.01); *B65H 19/126* (2013.01); *B65H 75/08* (2013.01); *B65H 2301/41342* (2013.01); *B65H 2301/41398* (2013.01); *B65H 2301/413223* (2013.01); *B65H 2402/5152* (2013.01); *B65H 2403/46* (2013.01); *B65H 2405/40* (2013.01); *B65H 2511/12* (2013.01); *B65H 2701/1936* (2013.01); *B65H 2801/03* (2013.01); *B65H 2801/12* (2013.01)

(58) Field of Classification Search

CPC ..... B65H 16/06; B65H 75/08; B65H 19/126; B65H 2301/41398; B65H 2511/12; B65H 2801/12; B65H 2701/1936; B65H 2403/46; B65H 2301/41342; B65H 2301/413223; B65H 2402/5152; B65H 2801/03; B65H 2405/40; B41J 15/02; B41J 15/042

See application file for complete search history.

(56) References Cited

U.S. PATENT DOCUMENTS

| | | | | |
|---|---|---|---|---|
| 5,587,044 | A * | 12/1996 | Goto | B65C 9/40 156/542 |
| 5,813,343 | A * | 9/1998 | Harb | B65H 16/06 101/212 |
| 6,302,604 | B1 | 10/2001 | Bryant et al. | |
| 6,431,492 | B1 * | 8/2002 | Chillscyzn | B41J 15/042 242/577 |
| 6,503,008 | B2 | 1/2003 | Zevin et al. | |

(Continued)

*Primary Examiner* — William A. Rivera
(74) *Attorney, Agent, or Firm* — Lipsitz & McAllister, LLC

(57) ABSTRACT

Methods and apparatus for supporting a paper roll in a paper bucket of a printer are provided. The paper bucket may comprise a curved base portion for accepting paper rolls of varying widths, two oppositely disposed side walls movably mounted to the curved base portion, and a two-part spring-loaded spindle assembly extending through each of the side walls and adapted to support a paper roll therebetween. Each spindle assembly may comprise a first spring loaded spindle part and a second spring loaded spindle part movably connected to one another.

23 Claims, 13 Drawing Sheets

(56) References Cited

U.S. PATENT DOCUMENTS

| | | | | |
|---|---|---|---|---|
| 6,959,635 | B2 * | 11/2005 | Tramontina | A47K 10/38 225/20 |
| 7,004,462 | B2 * | 2/2006 | Bryer | B65H 9/101 271/145 |
| 7,175,129 | B2 * | 2/2007 | Rudi | G11B 15/60 226/192 |
| 7,600,684 | B2 * | 10/2009 | Tobin | B41J 2/32 235/432 |
| 7,802,750 | B2 * | 9/2010 | Takeuchi | B41J 15/042 242/423 |
| 7,854,427 | B2 * | 12/2010 | Tsujinishi | B65H 9/08 271/171 |
| 8,500,058 | B2 * | 8/2013 | Lan | B41J 15/042 242/578 |
| 8,925,854 | B2 * | 1/2015 | Chen | B65H 16/06 242/578.1 |
| 2002/0121566 | A1 | 9/2002 | Fiutak et al. | |
| 2003/0141655 | A1 * | 7/2003 | Bryer | B65H 9/101 271/264 |
| 2005/0002721 | A1 * | 1/2005 | Koyabu | B41J 16/06 101/212 |
| 2005/0199763 | A1 | 9/2005 | Myers et al. | |
| 2011/0200375 | A1 | 8/2011 | Kokawa et al. | |
| 2011/0215189 | A1 * | 9/2011 | Asai | B65H 16/06 242/596.4 |

* cited by examiner

TWO-PART SPINDLE MECHANISM FOR A PRINTER PAPER BUCKET, A PRINTER PAPER BUCKET, AND A PRINTER HAVING A PAPER BUCKET WITH A TWO-PART SPINDLE MECHANISM

BACKGROUND OF THE INVENTION

The present invention relates to the field of printers. More specifically, the present invention relates to a two-part spindle mechanism for a paper bucket of a printer that uses rolls of paper.

Printers that print from paper rolls are widely used in various locations, including at the point of sale in retail establishments, in kiosks such as ATM and ticket machines, in lottery machines, and anywhere the printing of labels is required, such as in the food preparation area of fast food restaurants or the like. Such printers include label printers, ticket printers, receipt printers, and the like (collectively referred to herein as "label and receipt printers").

Prior art roll printers typically employ either a paper bucket without any spindle support for the paper roll, where the paper roll rides on the bottom of the paper bucket, or a removable spindle that spans across the paper bucket. If no spindle support is provided, unnecessary drag on the paper roll is created, resulting in increased potential for paper jams or rips, and requiring a more robust paper drive mechanism. Paper buckets utilizing a spindle that spans the paper bucket are difficult to use as the spindle must be at least partially removed for paper loading, and are not easily adjustable to different paper widths.

It would be advantageous to provide a paper bucket that enables easy paper roll loading and removal, including drop-in or push-in paper loading. It would also be advantageous to provide a paper bucket that can accommodate large paper rolls without excess drag. It would be further advantageous to provide a paper bucket that is easily adjustable to accommodate paper rolls of varying widths.

The apparatus and methods of the present invention provide the foregoing and other advantages.

SUMMARY OF THE INVENTION

The present invention relates a two-part spindle mechanism for a paper bucket of a printer that uses rolls of paper, as well as a paper bucket having such a spindle mechanism, a printer having a paper bucket with such a spindle mechanism, and corresponding methods.

In an example embodiment of a paper bucket for a printer in accordance with the present invention, the paper bucket may comprise a curved base portion for accepting paper rolls of varying widths, two oppositely disposed side walls movably mounted to the curved base portion, and a two-part spring-loaded spindle assembly extending through each of the side walls and adapted to support a paper roll therebetween. Each spindle assembly may comprise a first spring loaded spindle part and a second spring loaded spindle part movably connected to one another.

The first and second spindle parts of each of the spindle assemblies may be movably connected to one another via a pin and hole arrangement. In one example embodiment, the first spindle part may be arranged below the second spindle part. Each of the spindle parts may be pivotally connected to an outer side of the corresponding side wall.

The first spindle part may have chamfered bottom and side surfaces, and a flat upper surface. The second spindle part may have chamfered side surfaces, a flat bottom surface, and a flat upper surface.

The pin may extend from one of the upper surface of the first spindle part or the bottom surface of the second spindle part. The hole may be arranged in the other of the upper surface of the first spindle part or the bottom surface of the second spindle part.

The first spindle part and the second spindle part of each of the spindle assemblies may be biased by a biasing force into a position extending into the paper bucket. In such an embodiment, asserting a force against the biasing force on one of the first spindle part or the second spindle part results in movement of both the first spindle part and the second spindle part in a direction away from an interior of the paper bucket. The biasing force for each of the spindle parts may be provided by a corresponding spring mechanism. The spring mechanism may comprise an arrangement of one or more springs, a resilient member, or the like.

The paper bucket may further comprise a drive mechanism for moving the side walls. The drive mechanism may comprise a worm gear with opposing externally threaded sections. Each of the side walls may be mounted on a corresponding one of the threaded sections via one of corresponding internally threaded sections of the side walls or corresponding internally threaded mounting blocks connected to the side walls. The worm gear may be mounted to side supports of the paper bucket.

The drive mechanism may also comprise a thumb wheel and gear mechanism connected to the worm gear for adjusting positioning of the side walls to accommodate varying paper widths.

Each of the side walls may be guided for mutual displacement along the base portion by inter-engaging sections of the side walls and sections of the curved base portion.

The paper bucket may be mounted in a printer housing of a printer. The printer housing may be pivotally mounted on a base to provide at least one of a vertical or horizontal mounting arrangement. Such an arrangement enables either wall mounting or table mounting of the printer, or mounting on an inclined surface.

The present invention also encompasses a support for supporting a paper roll in a paper bucket of a printer. In one example embodiment, a support for supporting a paper roll may comprise a two-part spring-loaded spindle assembly extending through each of two oppositely disposed side walls of a paper bucket and adapted to support a paper roll therebetween. Each spindle assembly may comprise a first spring loaded spindle part and a second spring loaded spindle part movably connected to one another.

The first and second spindle parts of each of the spindle assemblies may be movably connected to one another via a pin and hole arrangement. The first spindle part may have chamfered bottom and side surfaces, and a flat upper surface. The second spindle part may have chamfered side surfaces, a flat bottom surface, and a flat upper surface. The pin may extend from one of the upper surface of the first spindle part or the bottom surface of the second spindle part. The hole may be arranged in the other of the upper surface of the first spindle part or the bottom surface of the second spindle part.

The support may also comprise additional features described herein in connection with the paper bucket or printer having such a paper bucket.

The present invention also encompasses a printer with a paper bucket as set forth above. An example embodiment of such a printer may comprise a printer housing, and at least one paper bucket mounted in the printer housing. Each of the at least one paper buckets may comprise a curved base portion for accepting paper rolls of varying widths, and two oppositely disposed side walls movably mounted to the curved base portion. A two-part spring-loaded spindle assembly may be provided which extends through each of the side walls and is adapted to support a paper roll therebetween. Each spindle assembly may comprise a first spring loaded spindle part and a second spring loaded spindle part movably connected to one another.

The at least one paper bucket may comprise two paper buckets.

The printer may further comprise a base. The printer housing may be pivotally mounted on the base to provide at least one of a vertical or horizontal mounting arrangement.

The printer may also include additional features discussed above in connection with the various embodiments of the paper bucket and support.

A method for providing a paper bucket for a printer may also be provided. An example embodiment of such a method may comprise providing a curved base portion for accepting paper rolls of varying widths, movably mounting two oppositely disposed side walls to the curved base portion, and providing a two-part spring-loaded spindle assembly which extends through each of the side walls and is adapted to support a paper roll therebetween. Each spindle assembly may comprise a first spring loaded spindle part and a second spring loaded spindle part movably connected to one another.

Corresponding methods for providing a support for a paper roll and a printer are also encompassed by the present invention.

The methods may also include additional features discussed above in connection with the various embodiments of the paper bucket, support, and printer.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
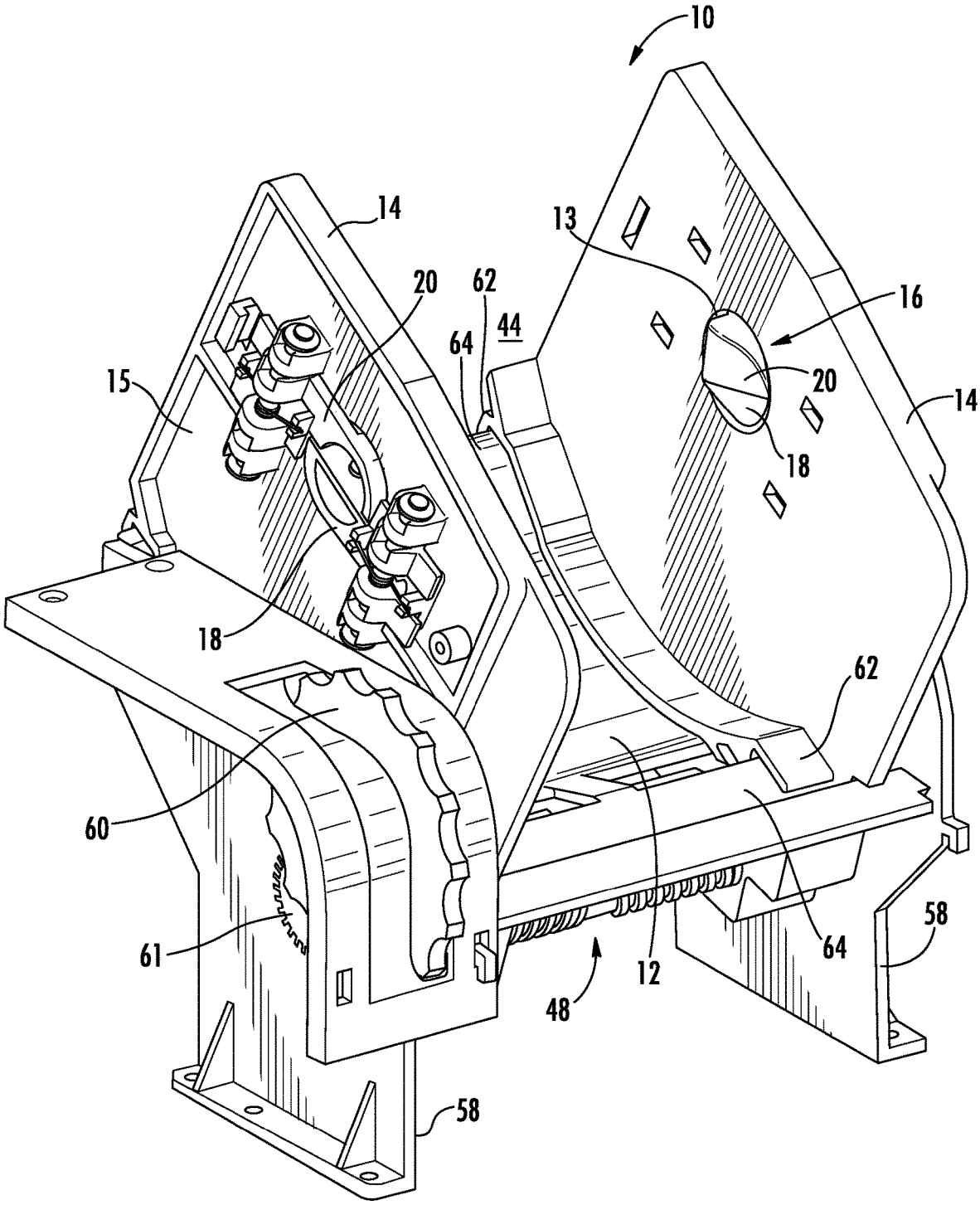
FIG. 1 shows an example embodiment of a paper bucket with spindle assemblies in accordance with the present invention.

An example embodiment of a paper bucket 10 for a printer in accordance with the present invention is shown in FIG. 1. The paper bucket 10 may comprise a curved base portion 12 for accepting paper rolls of varying widths, two oppositely disposed side walls 14 movably mounted to the curved base portion 12, and a two-part spring-loaded spindle assembly 16 extending through openings 13 in each of the side walls 14 and adapted to support a paper roll therebetween.

Figure 2:
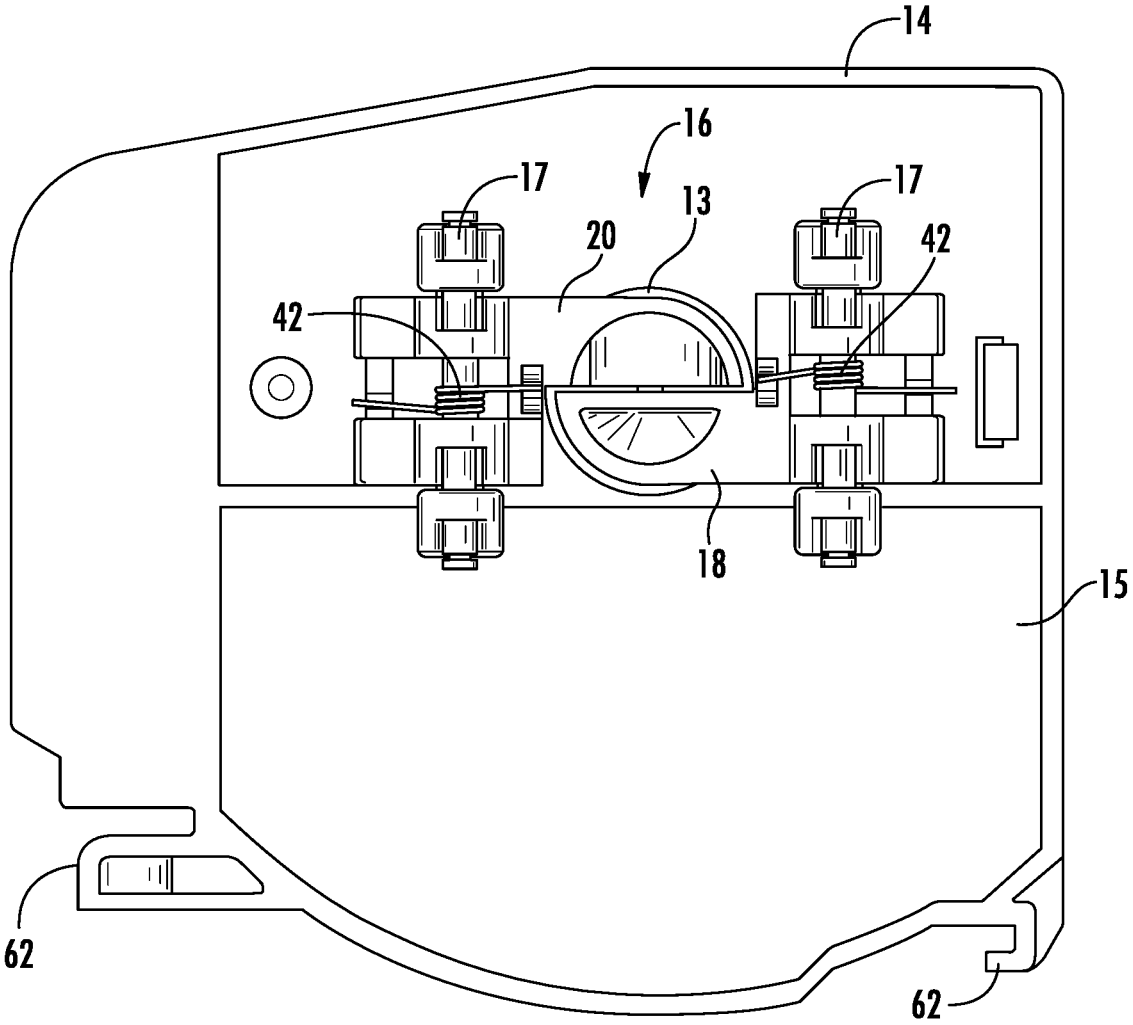
FIG. 2 shows a spindle assembly of FIG. 1 in a side wall of the paper bucket viewed from an outside of the paper bucket.
Figure 3:
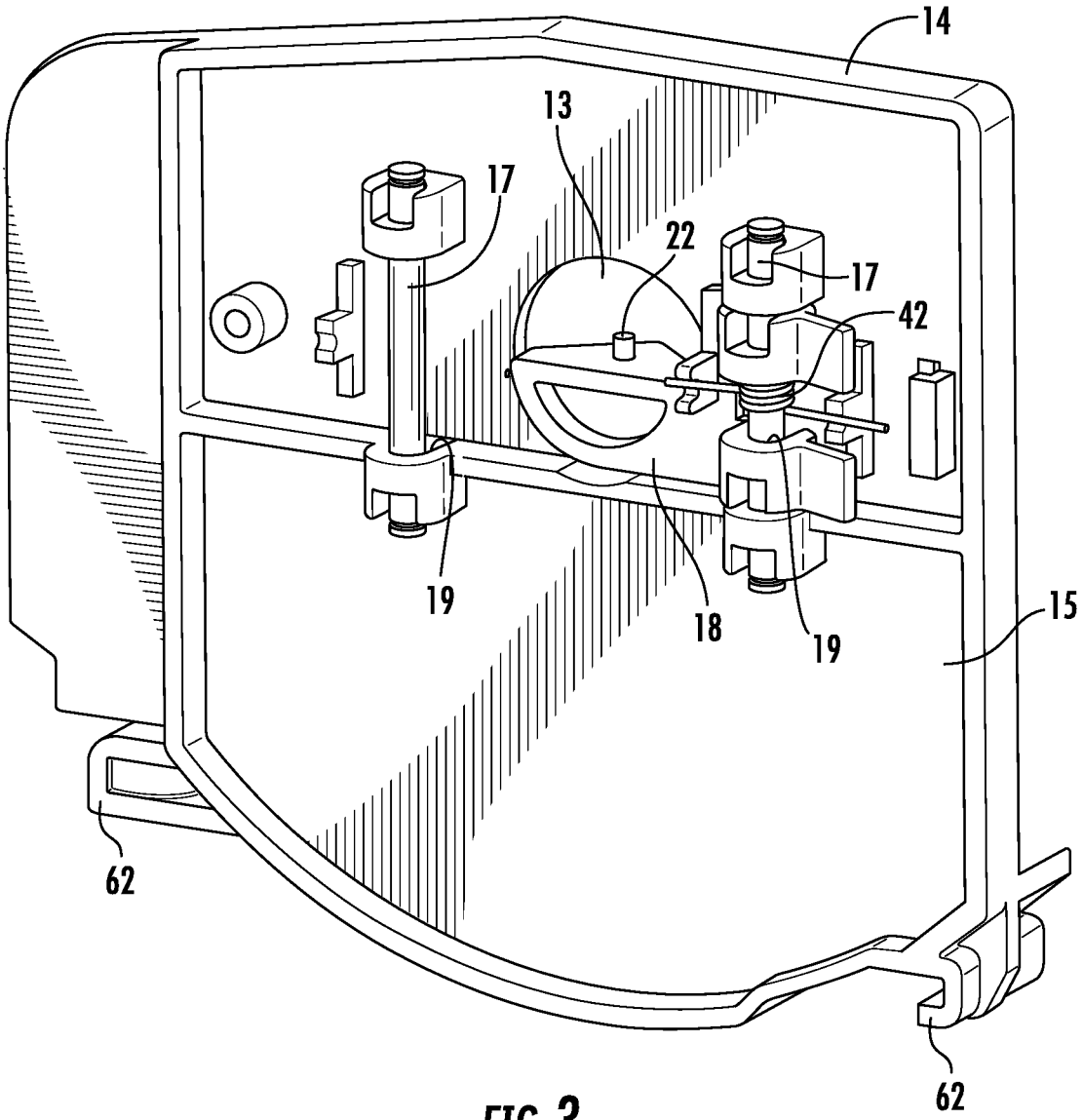
FIG. 3 shows a first portion of the spindle assembly of FIG. 2.
Figure 4:
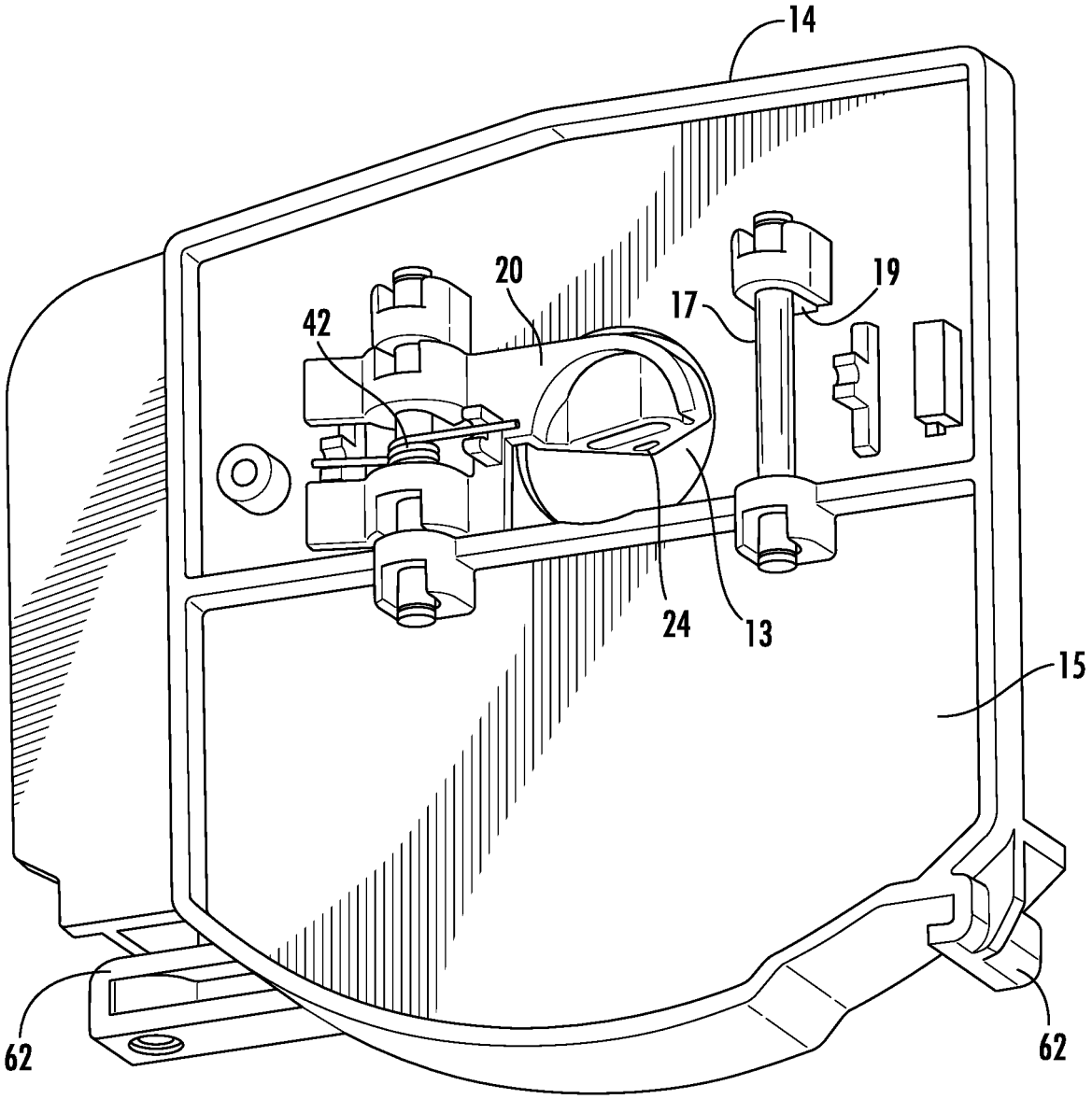
FIG. 4 shows a second portion of the spindle assembly of FIG. 2 from a perspective view.

As shown in FIGS. 2-4, each spindle assembly 16 may comprise a first spring loaded spindle part 18 and a second spring loaded spindle part 20 movably connected to one another. FIG. 2 shows both spindle parts 18 and 20. For clarity, FIG. 3 shows only the first spindle part 18 and FIG. 4 shows only the second spindle part 20.

The first and second spindle parts 18 and 20 of each of the spindle assemblies may be movably connected to one another via a pin and hole arrangement. For example, the first spindle part 18 may be provided with a pin 22 that extends into a hole 24 in the second spindle part 20. In one example embodiment, the first spindle part 18 may be arranged below the second spindle part 20.

As shown in FIG. 4, each of the spindle parts 18 and 20 may be pivotally connected to an outer side 15 of the corresponding side wall 14, for example via a pin 17 and slot 19 arrangement. The pin 17 and slot 19 arrangements for each of the corresponding spindle parts 18 and 20 may be disposed on opposite sides of the opening 13 in the side wall 14.

Figure 5:
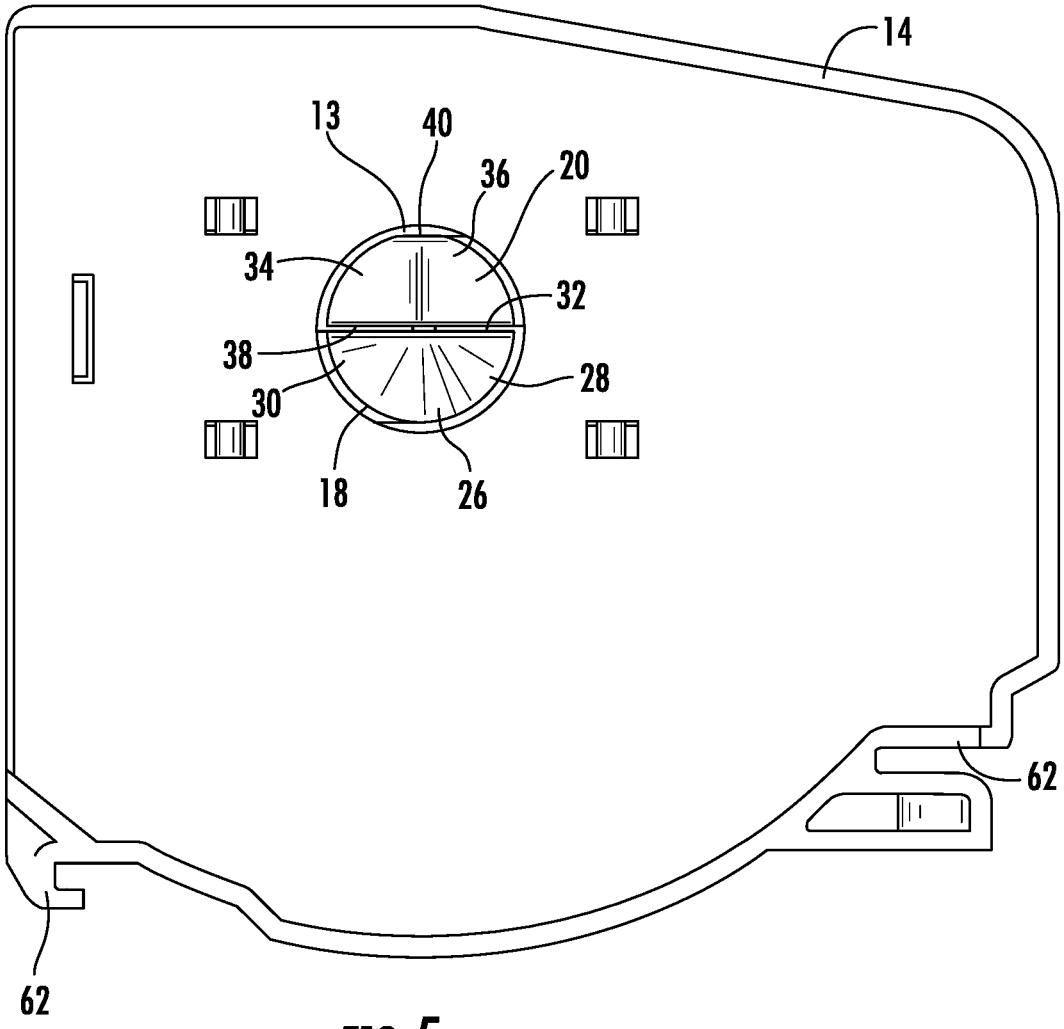
FIG. 5 shows a spindle assembly of FIG. 1 in a side wall of the paper bucket viewed from an inside of the paper bucket.

As shown in FIG. 5, the first spindle part 18 may have chamfered bottom 26 and side surfaces 28, 30, and a flat upper surface 32. The second spindle part 20 may have chamfered side surfaces 34, 36, a flat bottom surface 38, and a flat upper surface 40.

The pin 22 may extend from one of the upper surface 32 of the first spindle part 18 or the bottom surface 38 of the second spindle part 20. The hole 24 may be arranged in the other of the upper surface 32 of the first spindle part 18 or the bottom surface 38 of the second spindle part 20.

The first spindle part 18 and the second spindle part 20 of each of the spindle assemblies 16 may be biased by a biasing force into a position extending through the opening 13 and into an interior 44 of the paper bucket 10. In such an embodiment, asserting a force against the biasing force on either one of the first spindle part 18 or the second spindle part 20 results in movement of both the first spindle part 18 and the second spindle part 20 in a direction away from an interior 44 of the paper bucket (as described in detail in connection with FIG. 6 below). The biasing force for each of the spindle parts may be provided by a corresponding spring mechanism 42. The spring mechanism 42 may comprise an arrangement of one or more springs, a resilient member, or the like.

Due to the shape of each of the spindle parts 18 and 20 as shown in FIG. 5 and described above, the spindle assemblies 16 as a whole may have chamfered sides and a chamfered bottom, and a flat top. The chamfered sides enable the paper roll to be installed from the front or back of the paper bucket, as pushing the paper roll into the paper bucket from the front or the back engages the chamfered sides of the spindle assembly 16 and causes the spindle parts 18 and 20 to move out of the paper bucket against the biasing force of the spring mechanism 42. The chamfered sides and bottom of the spindle assemblies 16 enable the paper roll to be removed from either the front, the back, or the top of the paper bucket, as pulling the paper roll out of the paper bucket in any direction causes the paper roll to engage one of the chamfered sides or the chamfered bottom of the spindle assemblies 16, causing each of the first and second spindle parts 18 and 20 to move out of the paper bucket against the biasing force of the spring mechanism 42. The flat top surface 40 of the spindle assemblies 16 prevents the paper roll from effecting any movement of the first and second spindle parts 18 and 20, and serves to suspend the paper roll above the curved base portion 12 of the paper bucket 10.

Figure 6:
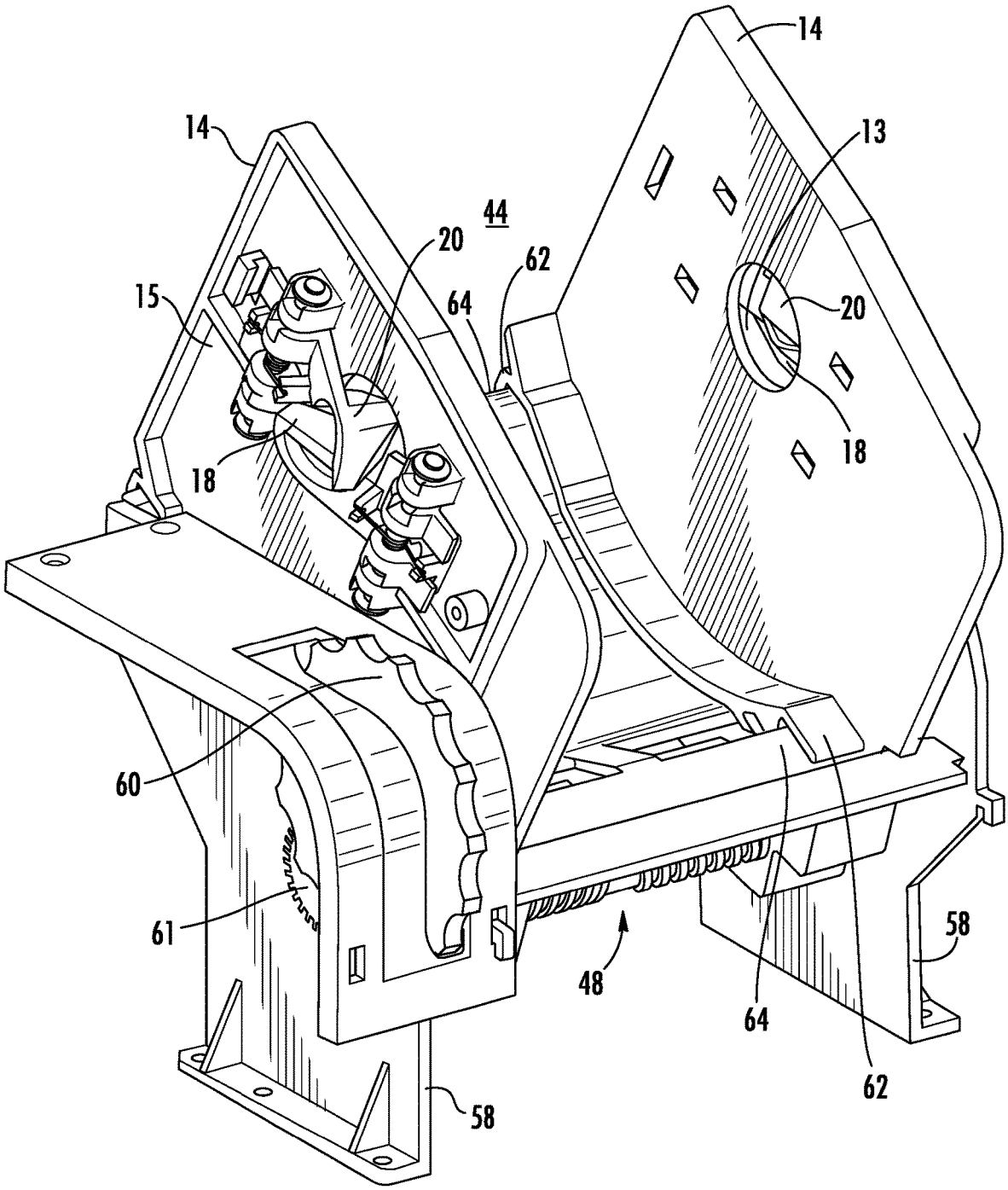
FIG. 6 shows the paper bucket of FIG. 1 with the spindle assemblies in a pushed-out position.

In particular, forces exerted by the outside of the paper roll (on insertion) or by the inside of the paper roll (on removal) against any of the chamfered surfaces 26, 28, 30, 34, or 36 of either of the spindle parts 18 or 20 results in movement of the both of the spindle parts 18 and 20 in a direction out of the opening 13, as a result of the connection between the spindle parts 18 and 20 provided by the pin 22 and hole 24. FIG. 6 shows the paper bucket 10 with the spindle assemblies 16 in an opened or pushed out position, for example when engaged by a paper roll pushing on the spindle assembly 16 against the biasing force of the spring mechanism 42. As shown in FIG. 6, the spindle parts 18 and 20 move together with a scissoring type action due to the pin 22 and hole 24 connection and the mounting of the spindle parts 18 and 20 on respective opposite sides of the opening 13.

The shape of the spindle assemblies 16 allows for the loading of the paper roll without the need to adjust the side walls 14 in or out when replacing a paper roll of equal widths. In addition, such a configuration can accommodate large paper rolls without excess drag. For example, the spindle assemblies 16 of the present invention enable a print mechanism to work with larger paper rolls. For example, with the present invention, a print mechanism that was able to advance at the most a 2.2 inch wide paper roll with a 4 inch diameter is now capable of advancing a three inch wide paper roll with a five inch diameter without any increase in drag.

Figure 7:
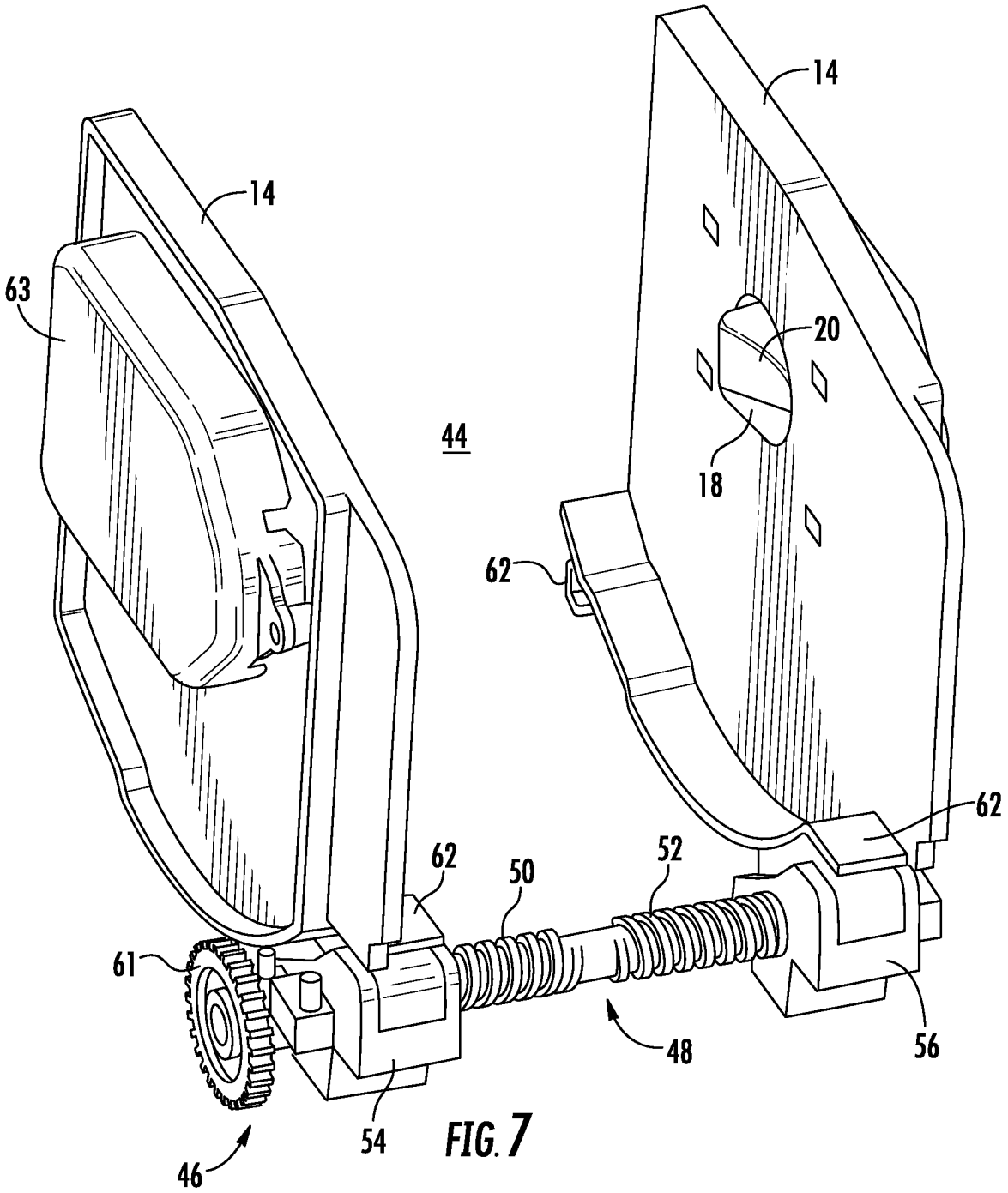
FIG. 7 shows an example embodiment of a drive mechanism for the side walls of a paper bucket in accordance with the present invention.

As shown in FIG. 7, the paper bucket may further comprise a drive mechanism 46 for moving the side walls 14 in or out to accommodate paper rolls of varying widths. The drive mechanism 46 may comprise a worm gear 48 with opposing externally threaded sections 50, 52. Each of the side walls 14 may be mounted on a corresponding one of the threaded sections 50, 52 via one of corresponding internally threaded sections of the side walls 14 or corresponding internally threaded mounting blocks 54, 56 connected to the side walls 14. The worm gear 48 may be mounted to side supports 58 of the paper bucket 10, as shown in FIG. 1. FIG. 7 also shows an optional cover 63 that may be provided over the outer part of the spindle assemblies 16.

The drive mechanism 46 may also comprise a thumb wheel 60 (FIG. 1) and a gear mechanism 61 (FIG. 7), which may be connected to the worm gear 48 for adjusting positioning of the side walls 14 to accommodate varying paper widths.

One of the threaded sections 50, 52 of the worm gear 48 may comprise left-handed threads while the other of the threaded sections may comprise right-handed threads. Thus, moving the thumb wheel 60 in one direction simultaneously moves both side walls 14 towards one another, and moving the thumb wheel 60 in the opposite direction simultaneously moves both side walls 14 away from one another. In this manner, the width of the paper bucket can be easily adjusted to accommodate paper rolls of varying widths. For example, paper rolls of any increment in size between approximately one to three inches wide (or more) can be accommodated easily in accordance with an example embodiment of the present invention. Those skilled in the art will appreciate that different ranges in paper roll size may be easily accommodated by providing differently sized paper buckets and/or a longer or shorter worm gear.

Each of the side walls 14 may be guided for mutual displacement along the base portion 12 by inter-engaging sections 62 of the side walls 14 and sections 64 of the curved base portion 12. For example, the sections 62 of the side walls may be in the form of slots and the sections 64 of the curved base portion may be in the form of edge sections that engage in the slots.

Figure 8:
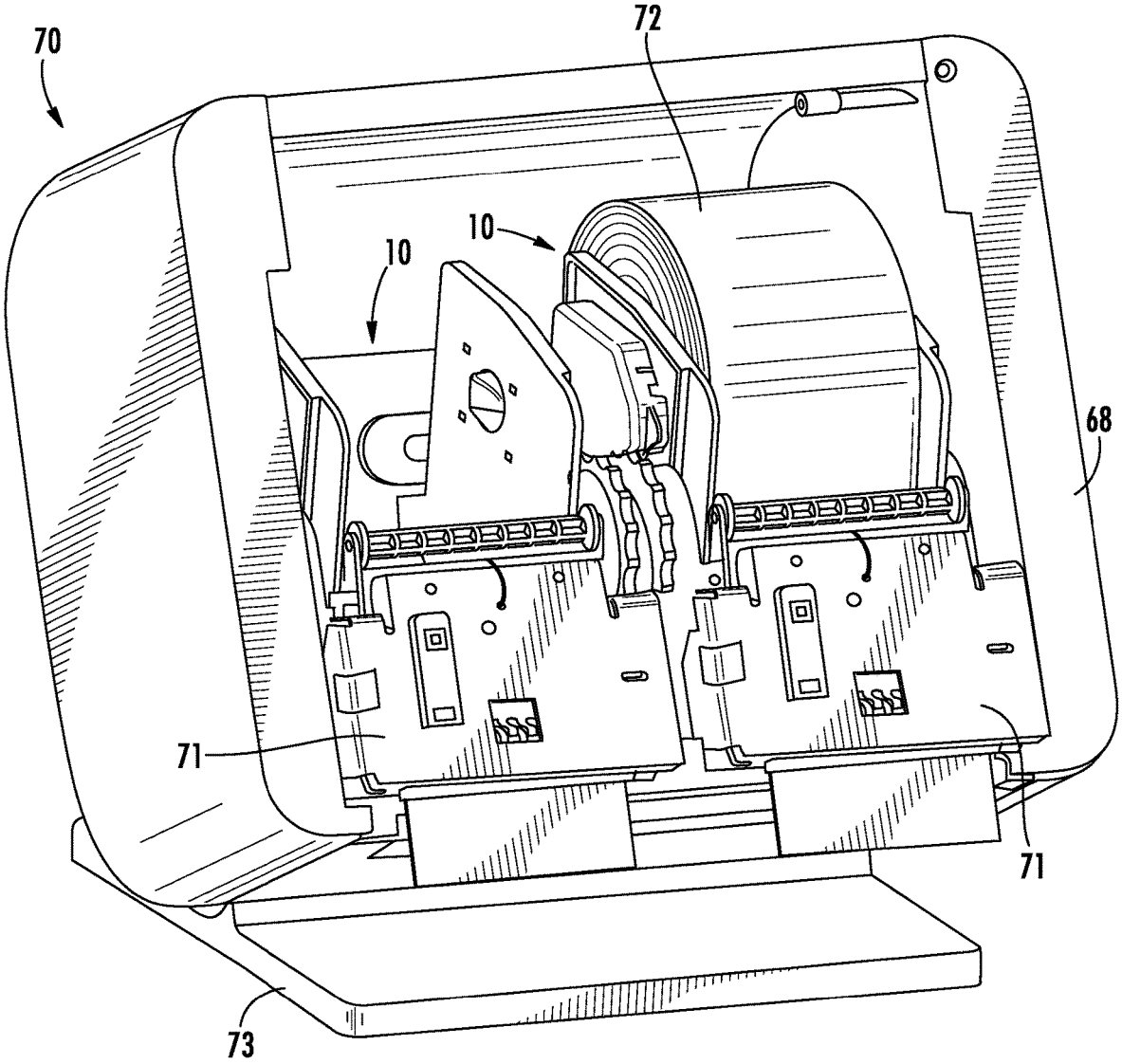
FIG. 8 shows an example embodiment of a printer with two paper buckets in accordance with the present invention.

As shown in FIG. 8, the paper bucket 10 may be mounted in a printer housing 68 of a printer 70. FIG. 8 shows an example embodiment of a printer 70 having two paper buckets 10 and two print mechanisms 71 (e.g., such as those used in the food services industry). However, the present invention is not limited to such an embodiment and those skilled in the art will appreciate that the printer 70 may comprise only a single print mechanism 71 with a single paper bucket 10. FIG. 8 shows the paper roll 72 positioned in one of the paper buckets 10.

Figure 9:
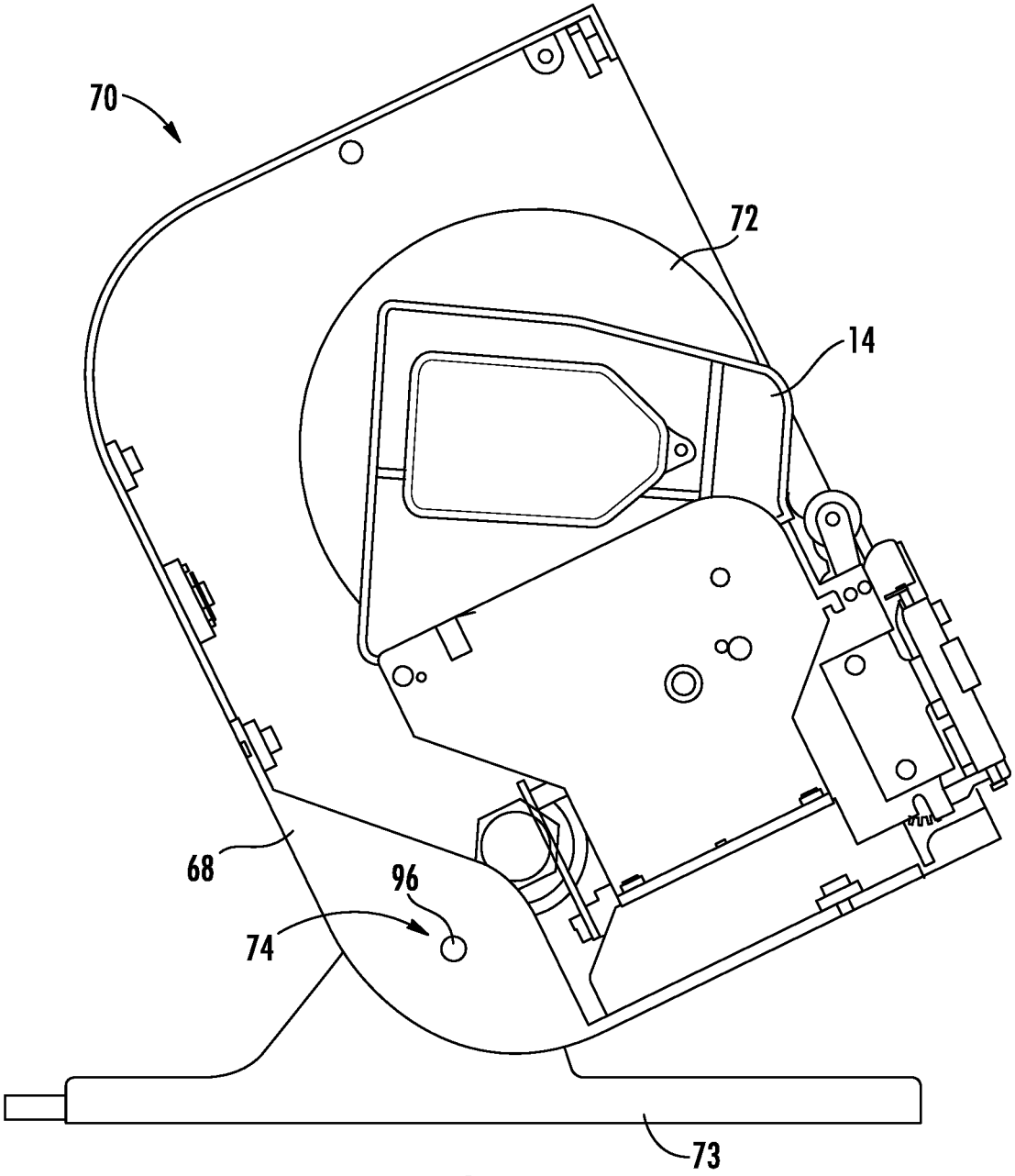
FIG. 9 shows an example embodiment of a horizontal mounting arrangement of a printer in accordance with the present invention.
Figure 10:
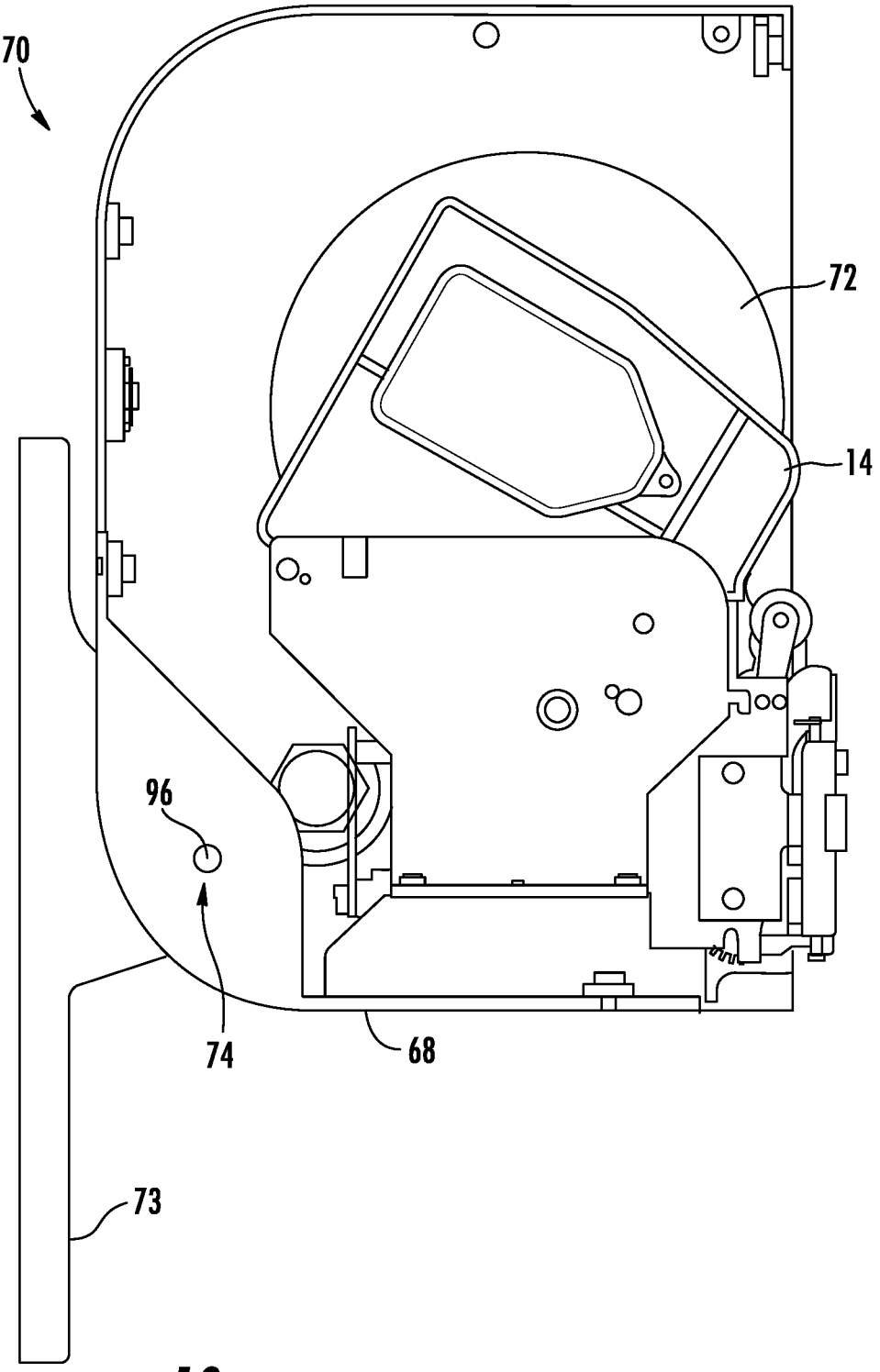
FIG. 10 shows an example embodiment of a vertical mounting arrangement of a printer in accordance with the present invention.

The printer housing 68 may be pivotally mounted on a base 73 to provide at least one of a vertical or horizontal mounting arrangement. FIG. 9 shows a horizontal mounting arrangement of the printer housing 68 and base 73, to enable, for example, table mounting of the printer 70. FIG. 10 shows a vertical arrangement of the printer housing 68 and base 73, to enable, for example, wall mounting of the printer 70. The printer housing 68 and the base 73 may be connected by a pivot mechanism 74. The pivot mechanism 74 may comprise a pin/rod and hole arrangement, a ball and socket arrangement, a hinge arrangement, or the like. A locking mechanism may be provided for locking the printer housing 68 in a particular position with respect to the base 73. The pivot mechanism 74 may also enable mounting of the printer 70 on an inclined surface.

Figure 11:
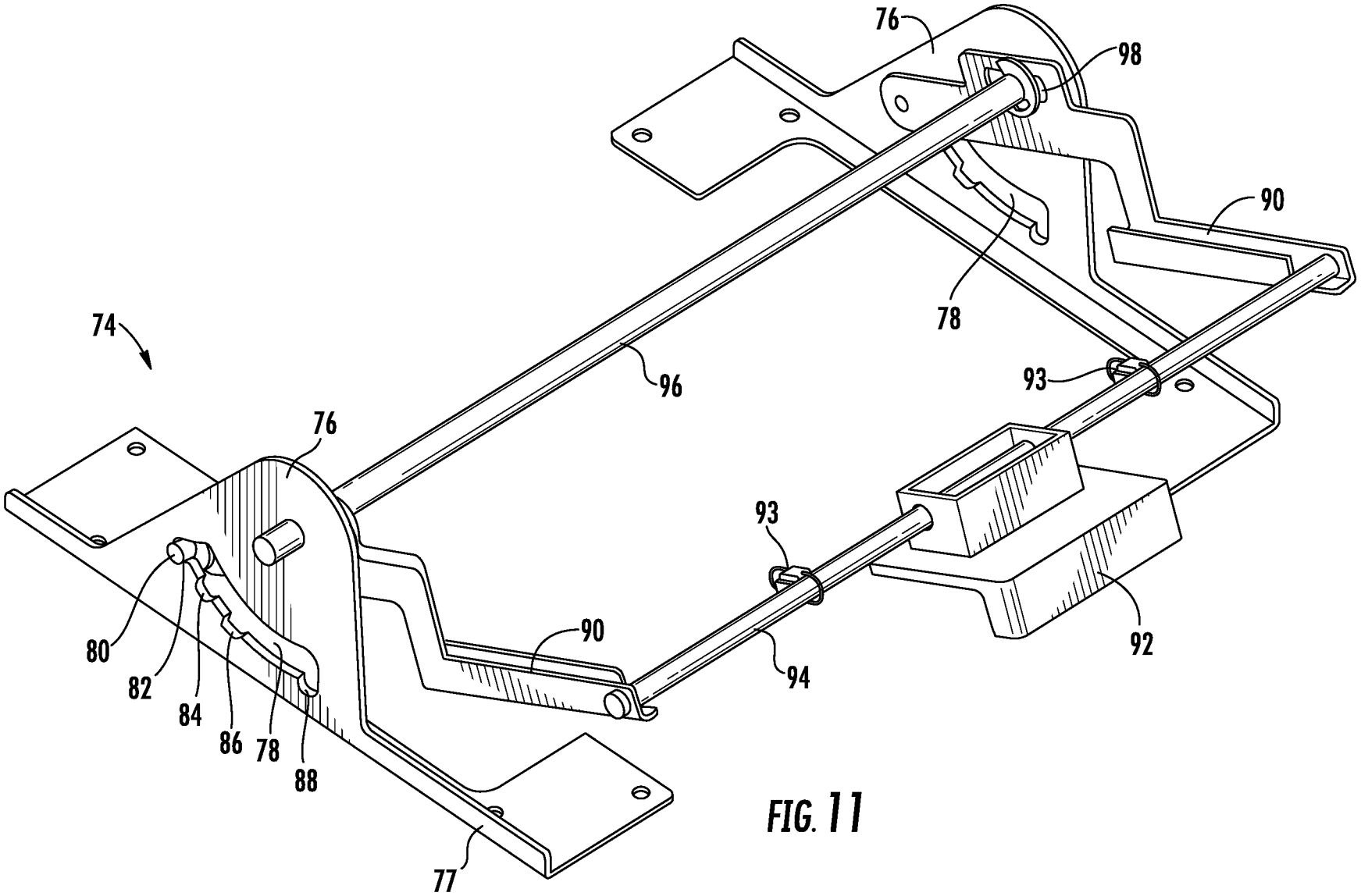
FIGS. 11-13 show an example embodiment of a pivot mechanism for a printer housing in accordance with the present invention.
Figure 12:
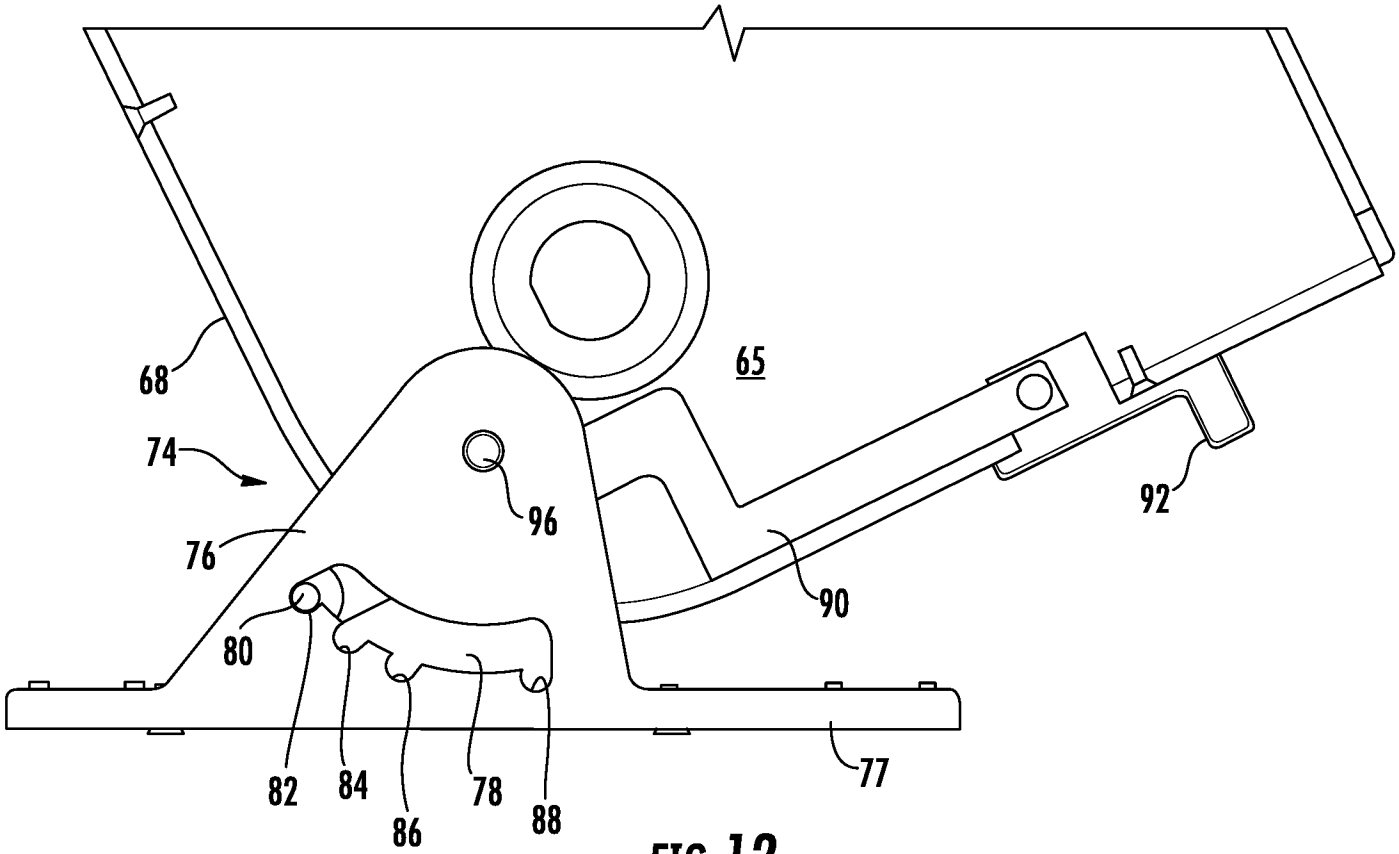
Figure 13:
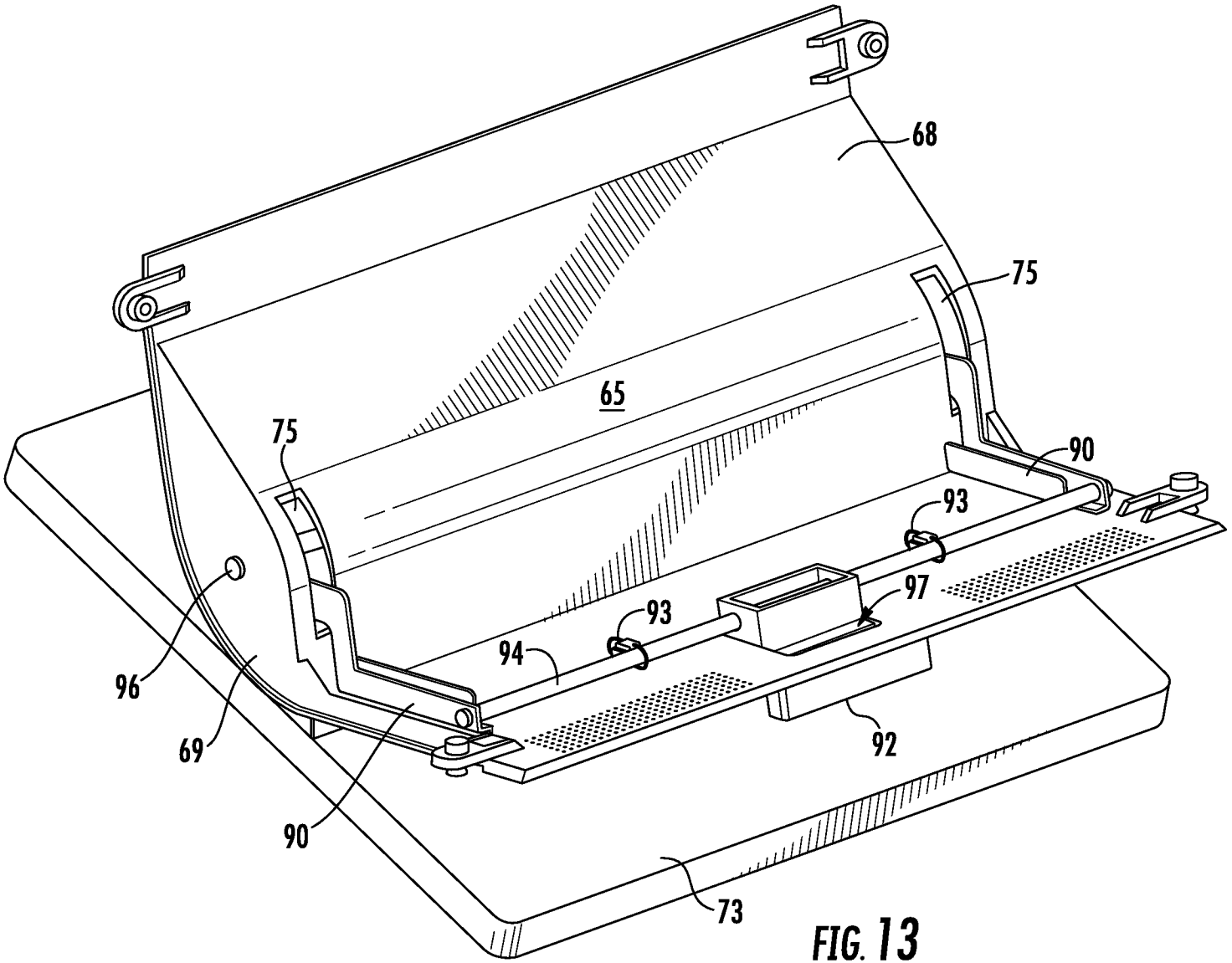

FIG. 11 shows an example embodiment of a pivot mechanism 74 for a printer housing 68. FIG. 12 shows a side cutaway view of the pivot mechanism 74 installed in a printer housing 68. FIG. 13 shows a view of the pivot mechanism 74 within the housing 68.

In the example embodiment shown in FIGS. 11-13, the pivot mechanism 74 may comprise a base 77 having oppositely disposed side wall extensions 76. The base 77 may be mounted to an underside of the printer base 73 (which may be curved to accommodate the side wall extensions 76 as shown in FIG. 13). Each side wall extension 76 may have an arched slot 78. Each arched slot 78 may be provided with notches for locating a locking pin 80. FIGS. 11 and 12 show four notches in the slots 78. Notches 82, 84, and 86 are arranged in slot 78 to provide different viewing angles for the printer housing 68 in the table mounting position as shown in FIG. 9. A fourth notch 88, spaced apart from the other three notches 82, 84, 86, may be provided for a wall mounting arrangement (as shown in FIG. 10). Those skilled in the art will appreciate that additional notches may be provided for adjusting the printer angle in either the vertical or horizontal mounting positions. Each locking pin 80 is connected to a corresponding lever mechanism 90. The lever mechanisms 90 may extend through the base 73 and into an interior 65 of the housing 68 through slots 75 in the housing 68, as shown in FIG. 13. The lever mechanisms 90 may be simultaneously actuated via a pull handle 92. The pull handle 92 is connected to each of the lever mechanisms 90 via a connecting rod 94. The printer housing 68 pivots on a pivot rod 96. The pivot rod 96 may extend either outside of or within an interior 65 of the printer housing 68 into or through opposing sides of the printer housing 68 (or extensions 69 of the sides of the printer housing 68). Each of the lever mechanisms 90 comprises a slot 98 through which the pivot rod 96 passes. The pull handle 92 may extend into a notch or opening 97 in a lower front portion of the printer housing 68 for connection to the connecting rod 94 in the interior 65 of the printer housing. A biasing mechanism 93 may be provided for biasing the locking pins 80 into one of the notches 82, 84, 86, or 88. The biasing mechanism may comprise, for example, one or more biasing springs 93 connected between the connecting rod 94 and an interior 65 of the housing 68, as shown in FIG. 13.

In operation, to adjust an angle of the printer housing 68, the pull handle 92 is pulled, engaging the lever mechanisms 90, which results in removal of the locking pins 80 from their positions in one of the notches 82, 84, 86, or 88. The slots 98 permit the lever mechanisms 90 freedom of movement to disengage and reengage the locking pins 80 from the notches 82, 84, 86, or 88, while at the same time guiding the pivoting motion about the pivot rod 96. Once the locking pins 80 are disengaged from the corresponding notch (82, 84, 86 or 88), the printer housing 68 can be pivoted about the pivot rod 96 into a desired position, at which time the pull handle 92 can be released. Upon release of the pull handle 92, the biasing force of the biasing spring(s) 93 urges the locking pins 80 into a notch corresponding to the desired position, upon alignment of the locking pins 80 and the corresponding notches.

The present invention also encompasses a support for supporting a paper roll in a paper bucket of a printer. The support for supporting a paper roll may comprise a two-part spring-loaded spindle assembly 16 extending through each of two oppositely disposed side walls 14 of a paper bucket 10 and adapted to support a paper roll therebetween, as discussed above.

The present invention also encompasses a printer 70 with a paper bucket 10 as discussed above.

In addition, the present invention also encompasses a method for providing a paper bucket 10 for a printer 70. An example embodiment of such a method may comprise providing a curved base portion 12 for accepting paper rolls of varying widths, movably mounting two oppositely disposed side walls 14 to the curved base portion 12, and providing a two-part spring-loaded spindle assembly 16 which extends through each of the side walls and which is adapted to support a paper roll therebetween, as discussed above.

Corresponding methods for providing a support for a paper roll and a printer are also encompassed by the present invention.

The support, the printer, and the methods may also include additional features of the various embodiments of the paper bucket discussed above and set forth in the Figures.

It should now be appreciated that the present invention provides advantageous methods and apparatus for supporting a paper roll in a paper bucket of a printer.

Although the invention has been described in connection with various illustrated embodiments, numerous modifications and adaptations may be made thereto without departing from the spirit and scope of the invention as set forth in the claims.

What is claimed is:

1. A paper bucket for a printer, comprising:

a curved base portion for accepting paper rolls of varying widths;

two oppositely disposed side walls movably mounted to the curved base portion;

a two-part spring-loaded spindle assembly extending through each of the side walls and adapted to support a paper roll therebetween;

each of the spindle assemblies comprising a first spring loaded spindle part and a second spring loaded spindle part movably connected to one another;

wherein the first spindle part and the second spindle part of each of the spindle assemblies extend into an interior of the paper bucket.

2. A paper bucket in accordance with claim 1, wherein the first and second spindle parts of each of the spindle assemblies are movable connected to one another via a pin and hole arrangement.

3. A paper bucket in accordance with claim 2, wherein the first spindle part is arranged below the second spindle part.

4. A paper bucket in accordance with claim 3, wherein:

the first spindle part has chamfered bottom and side surfaces, and a flat upper surface; and the second spindle part has chamfered side surfaces, a flat bottom surface, and a flat upper surface.

5. A paper bucket in accordance with claim 4, wherein:

the pin extends from one of the upper surface of the first spindle part or the bottom surface of the second spindle part; and the hole is arranged in the other of the upper surface of the first spindle part or the bottom surface of the second spindle part.

6. A paper bucket in accordance with claim 1, wherein the first spindle part and the second spindle part of each of the spindle assemblies are biased by a biasing force into a position extending into the interior of the paper bucket.

7. A paper bucket in accordance with claim 6, wherein asserting a force against the biasing force on one of the first spindle part or the second spindle part results in movement of both the first spindle part and the second spindle part in a direction away from the interior of the paper bucket.

8. A paper bucket in accordance with claim 6, wherein the biasing force for each of the spindle parts is provided by a corresponding spring mechanism.

9. A paper bucket in accordance with claim 1, further comprising a drive mechanism for moving the side walls, the drive mechanism comprising a worm gear with opposing externally threaded sections, each of the side walls being mounted on a corresponding one of the threaded sections via one of corresponding internally threaded sections of the side walls or corresponding internally threaded mounting blocks connected to the side walls.

10. A paper bucket in accordance with claim 9, wherein the worm gear is mounted to side supports of the paper bucket.

11. A paper bucket in accordance with claim 9, wherein the drive mechanism further comprises a thumb wheel and gear mechanism connected to the worm gear for adjusting positioning of the side walls to accommodate varying paper widths.

12. A paper bucket in accordance with claim 9, wherein the side walls are each guided for mutual displacement along the base portion by inter-engaging sections of the side walls and sections of the curved base portion.

13. A paper bucket in accordance with claim 1, wherein the paper bucket is mounted in a printer housing of a printer.

14. A paper bucket in accordance with claim 13, wherein the printer housing is pivotally mounted on a base to provide at least one of a vertical or horizontal mounting arrangement.

15. A paper bucket in accordance with claim 1, wherein each of the spindle parts is pivotally connected to an outer side of the corresponding side wall.

16. A support for supporting a paper roll in a paper bucket of a printer, comprising:

a two-part spring-loaded spindle assembly extending through each of two oppositely disposed side walls of a paper bucket and adapted to support a paper roll therebetween;

each of the spindle assemblies comprising a first spring loaded spindle part and a second spring loaded spindle part movably connected to one another;

wherein the first spindle part and the second spindle part of each of the spindle assemblies extend into an interior of the paper bucket.

17. A support in accordance with claim 16, wherein the first and second spindle parts of each of the spindle assemblies are movable connected to one another via a pin and hole arrangement.

18. A support in accordance with claim 17, wherein:

the first spindle part has chamfered bottom and side surfaces, and a flat upper surface; and the second spindle part has chamfered side surfaces, a flat bottom surface, and a flat upper surface.

19. A support in accordance with claim 18, wherein:

the pin extends from one of the upper surface of the first spindle part or the bottom surface of the second spindle part; and the hole is arranged in the other of the upper surface of the first spindle part or the bottom surface of the second spindle part.

20. A printer, comprising:

a printer housing;

at least one paper bucket mounted in the printer housing, each of the at least one paper buckets comprising;

a curved base portion for accepting paper rolls of varying widths;

two oppositely disposed side walls movably mounted to the curved base portion; and a two-part spring-loaded spindle assembly extending through each of the side walls and adapted to support a paper roll therebetween;

each of the spindle assemblies comprising a first spring loaded spindle part and a second spring loaded spindle part movably connected to one another;

wherein the first spindle part and the second spindle part of each of the spindle assemblies extend into an interior of the paper bucket.

21. A printer in accordance with claim 20, wherein the at least one paper bucket comprises two paper buckets.

22. A printer in accordance with claim 20, further comprising:

a base;

wherein the printer housing is pivotally mounted on the base to provide at least one of a vertical or horizontal mounting arrangement.

23. A method for providing a paper bucket for a printer, comprising:

providing a curved base portion for accepting paper rolls of varying widths;

movably mounting two oppositely disposed side walls to the curved base portion;

providing a two-part spring-loaded spindle assembly extending through each of the side walls and adapted to support a paper roll therebetween;

each of the spindle assemblies comprising a first spring loaded spindle part and a second spring loaded spindle part movably connected to one another;

wherein the first spindle part and the second spindle part of each of the spindle assemblies extend into an interior of the paper bucket.

* * * * *